US005431098A

United States Patent [19]

Winston

[11] Patent Number: 5,431,098

[45] Date of Patent: Jul. 11, 1995

[54] INK-IMPREGNATED SPONGES

[76] Inventor: Jeffrey M. Winston, 658 W. Shore Dr., Anacortes, Wash. 98221

[21] Appl. No.: 224,071

[22] Filed: Apr. 7, 1994

Related U.S. Application Data

[63] Continuation of Ser. No. 943,329, Sep. 10, 1992, abandoned.

[51] Int. Cl.[6] ..... B41M 1/14

[52] U.S. Cl. ..... 101/211; 101/202; 15/104.94; 15/184; 15/244.1

[58] Field of Search ..... 101/211, 202, 327, 333, 101/372, 373, 405, 406; 15/118, FIG. 2, 104.93, 227, 244.1, 244.2, 104.94, 184, 244.1, 210.1; 118/264, 265; 401/130

[56] References Cited

U.S. PATENT DOCUMENTS

| | | | |
|---|---|---|---|
| 200,389 | 2/1878 | Grinnan | 101/333 |
| D. 331,418 | 12/1992 | Winston | D18/15 |
| 386,574 | 7/1888 | Bradish | 15/244.1 |
| 602,061 | 4/1898 | Echelberger | 101/202 |
| 657,961 | 9/1900 | Roberts | 118/264 |
| 984,632 | 2/1911 | Winterbottom et al. | 101/368 |
| 1,073,036 | 9/1913 | Fuchs | 101/333 |
| 1,255,925 | 2/1918 | Peters | 118/201 |
| 1,512,085 | 10/1921 | Clary | 101/405 |
| 2,408,860 | 10/1946 | Lindblad | 15/244.1 |
| 3,158,096 | 11/1964 | Arnold | 101/368 |
| 3,163,903 | 12/1964 | Worthington | 15/244.1 |
| 3,282,209 | 1/1966 | Muskin | 101/202 |
| 3,817,178 | 6/1974 | Hagen | 101/379 |
| 4,004,376 | 1/1977 | Schepp et al. | 51/181 R |
| 4,752,147 | 6/1988 | Persi | 401/130 |
| 4,852,203 | 8/1991 | LaBelle | 15/244.1 |
| 4,996,735 | 3/1991 | Blankenship | 15/210.1 |
| 4,996,921 | 3/1991 | Hong | 101/327 |

FOREIGN PATENT DOCUMENTS

| | | | |
|---|---|---|---|
| 2514699 | 4/1983 | France | 101/333 |
| 0303202 | 2/1955 | Switzerland | 15/244.1 |
| 0587087 | 9/1945 | United Kingdom | 101/211 |

OTHER PUBLICATIONS

Stamp Products Resource Book 1994–1995, Clearsnap, Inc., Anacortes, Wash. pp. 44 and 48.

*Primary Examiner*—Edgar S. Burr
*Assistant Examiner*—Anthony H. Nguyen
*Attorney, Agent, or Firm*—Hughes, Multer & Schacht

[57] ABSTRACT

An apparatus for applying ink to an image on an ink stamp. The apparatus comprises an ink-impregnated sponge having side walls that intersect at a first end, where an angle between the side walls is acute at the first end. The side walls are so curved that: (a) a user can see the first end while bringing the sponges into contact with the image; and (b) the likelihood that ink will be applied to an undesired portion of the image is decreased.

5 Claims, 2 Drawing Sheets

INK-IMPREGNATED SPONGES

This is a continuation of application Ser. No. 07/943,329 filed on Sep. 10, 1992, abandoned.

TECHNICAL FIELD

The present invention relates to apparatus and methods for containing ink used with rubber stamps, and, more particularly, to such apparatus and methods used in the art stamping field.

BACKGROUND OF THE INVENTION

The stamping industry is divided into two distinct fields: the art stamping field and the industrial stamping field. In the industrial field, the impression to be formed usually comprises a single word or phrase formed in a single color. The paramount considerations in the design and manufacture of industrial ink stamps and related items are durability, consistency, and ease of use. The quality of the ink impression, the flexibility of the ink stamp, and the ability to form ink impressions comprised of a plurality of colors are of minimal importance.

In the art stamping field, on the other hand, the goal is to form an artistic image. Therefore, the quality of the ink impression, flexibility of the stamping apparatus, and ability to form multi-color images are highly valued. Considerations of durability and ease of use are important, after aesthetic considerations.

Given the different goals underlying the use of ink stamps in the art stamping field and in the industrial stamping field, very few products designed for use in one field are appropriate for use in the other field. This division between the two stamping fields is accentuated by the difference in the marketing and distribution channels for the two sets of products: art stamping supplies are usually sold through art, hobby supply, or gift stores, while industrial stamping supplies are usually available in office supply outlets.

The present invention is particularly effective when used in the field of art stamping. As briefly mentioned above, in the art stamping field it is highly desirable to form a single image ink impression in which the ink impression comprises two or more colors.

For example, if the stamp is designed to form an image of a flowering plant, the user may wish to form an image in which the flower is a first color and the leaves and stem are a second color. One method of accomplishing this is for the user to arrange the ink stamp so that the image thereon faces the user. The user then takes a first sponge impregnated with the ink of the first color and dabs the ink onto the flower portion of the flowering plant image. The user next dabs ink from a second sponge impregnated with ink of the second color onto the leaves and stem of the image. The user then brings the image in contact with a sheet of paper to transfer the ink from the ink stamp to the sheet of paper. Alternatively, the ink sponge may be arranged so that it faces the user and the stamp may be brought into contact with the sponge to transfer the ink to the desired portions of the image. The ink impression formed by either of the just-described methods is a single image ink impression comprising two colors.

The sponge impregnated with colored ink is normally rectangular in shape. This shape has been employed because: (a) a rectangular sponge can be easily manufactured with little waste of sponge; and (b) the corners of such a rectangular sponge allow ink to be placed onto the image with a fair degree of accuracy.

Images formed from ink applied from such rectangular shaped ink sponges are often unacceptable. Specifically, in many instances, known ink sponges do not allow ink to be dabbed or placed onto the stamp with sufficient accuracy to prevent smearing the first color applied with the second color applied.

PRIOR ART

A search of the prior art uncovered the following U.S. patent applications: (a) Ser. No. 4,004,376 issued to Shepp et al; (b) Ser. No. 3,817,178 issued to Hagen; (c) Ser. No. 3,158,096 issued to Lindblad; (d) Ser. No. 984,632 issued to Winterbottom et al; and (e) Ser. No. 657,961 issued to Roberts.

Of the foregoing patents, only the patents to Arnold, Winterbottom, and Roberts are related to the stamping industry. The Arnold patent shows a stamp assembly where the image forming portion has a variety of configurations. The Winterbottom patent shows a device for accurately stamping a decorative pattern on corners of wagon boards. Locating pins 6 and points 7 are located to position the pattern on the corner. The Roberts patent shows an inking pad with corners such as the rectangular ink sponges discussed above. Nothing in these patent solves the problem of accurately applying a plurality of colored inks on ink-impregnated sponges to a single image on a stamp.

The remaining patents are unrelated to the field of ink stamping and are disclosed as background information.

OBJECTS OF THE INVENTION

In view of the foregoing, it is apparent that an important object of the present invention is to provide improved ink sponges for the art stamping field.

Another important, but more specific, object of the present invention is to provide ink sponges having a favorable mix of the following factors:

a. allowing precise placement of ink onto a stamp;
b. easily allowing more than one color of ink to be applied to a stamp;
c. employing a raised inking surface;
d. having an aesthetically pleasing shape; and
c. may be simply and inexpensively tooled and automatically assembled.

SUMMARY OF THE INVENTION

These and other objects are achieved by the present invention, which is an apparatus for applying ink to an image on an ink stamp, comprising an ink-impregnated sponge having side walls that intersect at a first end and a centerline extending through the first end, where an angle between at least one of the side walls and the centerline is acute at the first end. Preferably, an angle between the side wall and the centerline becomes more acute at points on the side wall away from the first end.

Defining the shape of the side walls in a second manner, a straight line can be defined that is coplanar with the centerline and tangent to one of the sponge side walls. The angle between this tangential line and the centerline reduces as a point of intersection of the tangent line and the wall is moved along the sponge away from the first end. The side walls may alternatively be defined as being substantially ogival in configuration at the sponge end.

In the preferred embodiment, the sponge side walls additionally intersect at a second end, where the centerline also extends through the second end. These side walls are convex and symmetrically arranged about the centerline. Lines that are coplanar with each other and tangent to the two side walls at points on the walls midway between the first and second ends are parallel.

The present invention may also be defined in terms of an apparatus for applying ink to an image on an ink stamp. This apparatus comprises an ink-impregnated sponge defining two side walls that intersect at an end, where the walls are so curved that: (a) a user can see the end as ink is applied to the ink stamp; and (b) the likelihood that ink will be applied to an undesired portion of the image is decreased.

Finally, the present invention may be embodied in a method of applying ink to an image on an ink stamp, comprising the steps of: (a) providing a first sponge impregnated with a first color and having side walls that intersect at a first end and a centerline extending through the first end, where an angle between at least one of the side walls and the centerline is acute at the first end; (b) bringing a surface of the first ink-impregnated sponge into contact with a first portion of the image; (c) providing a second sponge impregnated with a second color and having having side walls that intersect at a first end and a centerline extending through the first end, where an angle between at least one of the side walls and the centerline is acute at the first end; and (d) bringing a surface of the second ink-impregnated sponge into contact with a second portion of the image. The side walls of the first and second ink-impregnated sponges are so curved that: (a) a user can see the first ends while bringing the sponges into contact with the image; and (b) the likelihood that ink will be applied to an undesired portion of the image is decreased.

DETAILED DESCRIPTION OF THE PREFERRED EMBODIMENT

Figure 1:
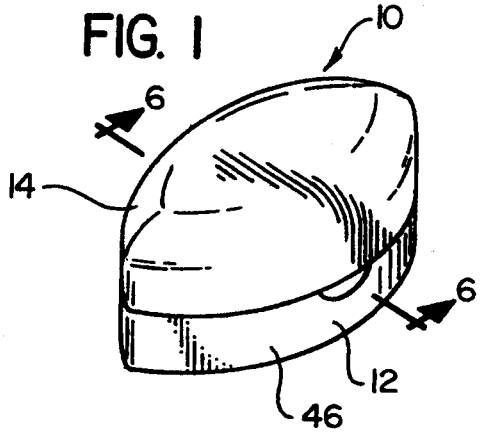
FIG. 1 is a perspective view of an ink applicator assembly containing an ink sponge constructed in accordance with the present invention.
Figure 2:
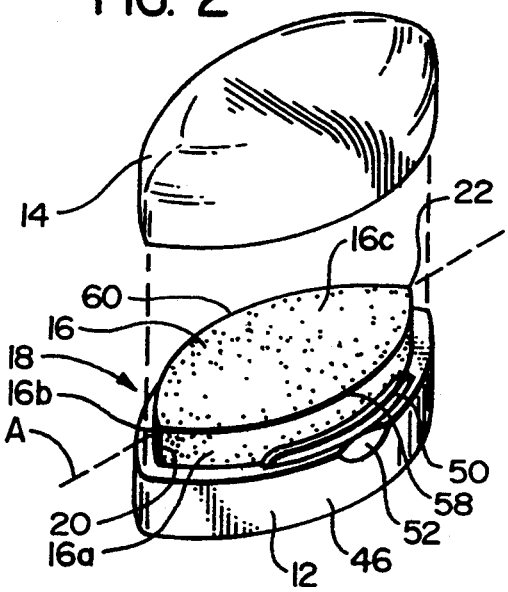
FIG. 2 is a perspective view of the ink applicator assembly shown in FIG. 1 with a lid thereof removed to expose the ink sponge.
Figure 3:
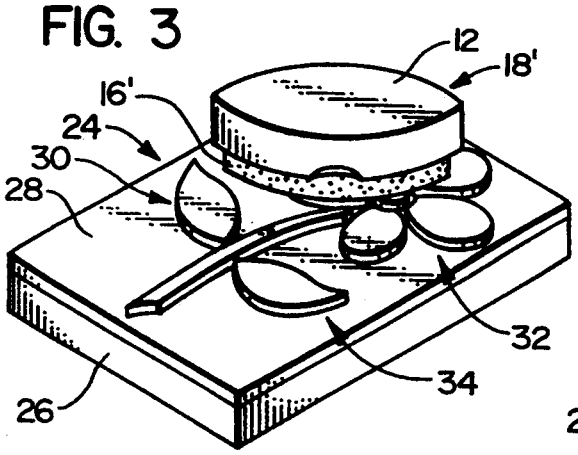
FIG. 3 is a perspective view shown the use of an ink sponge assembly incorporating the ink sponge of the present invention to apply ink to an ink stamp.

Turning now to the drawing, an ink applicator assembly constructed in accordance with, and embodying, the principles of the present invention is depicted at 10 in FIGS. 1–3. This ink applicator assembly 10 basically comprises: (a) a base portion 12; (b) a lid portion 14; and (c) an ink sponge 16. The ink sponge 16 is adhered to the base portion 12, and the lid portion 14 is adapted to mate with the base portion 12 to cover the ink sponge 16 when the assembly 12 is not in use. The combination of the base portion 12 and the ink sponge 16 will be referred to herein as an ink sponge assembly and identified by reference character 18.

The shape of the ink sponge 16 is unique and important to the implementation of the present invention. Specifically, walls **16*a* and 16*b* are convex such that the outline of these walls 16*a* and 16*b* when viewed from the top is generally in the shape of an oval having pointed ends. As will be discussed in detail below, the generally pointed-oval configuration of the ink sponge 16 greatly increases the user's ability to place ink onto an image formed on a stamp. This is because the walls 16*a* and 16*b* of the ink sponge 16 are so curved that: (a) the user can see pointed ends 20 and 22 of the ink sponge 16 as the ink sponge 16 is brought into contact with a stamp; and (b) the surface area of the sponge 16** in the vicinity of the stamp is reduced, thereby decreasing the likelihood that ink will be applied to an undesired portion of the stamp.

The process of applying ink to a stamp using the ink sponge assembly 18 will now be described with reference to FIGS. 3–5. Depicted at 24 in FIG. 3 is an ink stamp of the type typically used in conjunction with the present invention. The ink stamp 24 comprises a base portion 26 and a stamping portion 28. Formed in bas-relief on the stamping portion 28 is an image 30. In this example, the image 30 is in the shape of a flowering plant having a flower portion 32 and a stem/leaf portion 34. Applying ink to the image 30 on the stamping portion 28 and then bringing the image 30 into contact with a sheet of paper transfers ink to the paper to form an ink impression corresponding to the image 30 on the paper.

More particularly, as shown in FIG. 3, the ink stamp 24 is so arranged that the stamping portion 28 thereof faces upwardly. The ink sponge assembly 18 is then arranged to allow an outer surface **16*c* of the sponge 16 to be brought into contact with image 30. The perspective view of this process depicted in FIG. 3 shows that the end 20 of the ink sponge 16 which is brought into contact with the image 30** is clearly visible to the user.

Figure 4:
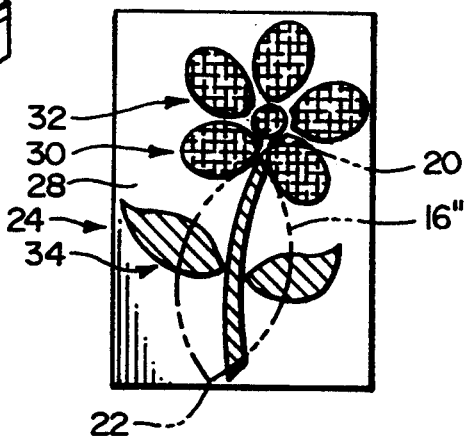
FIG. 4 is a top view schematically depicting the placement of the ink sponge of the present invention as used to apply ink to the ink stamp shown in FIG. 3.
Figure 5:
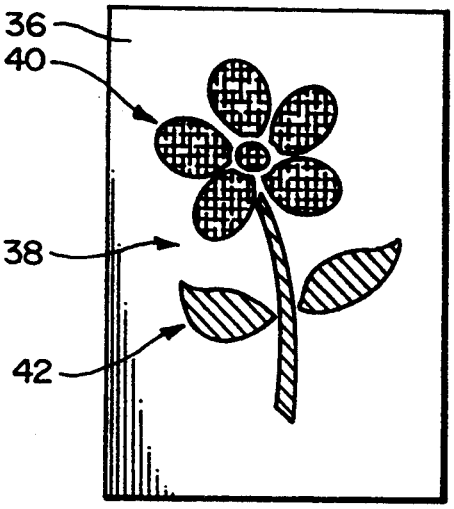
FIG. 5 is a top view of an ink impression formed by the ink stamp shown in FIGS. 3 and 4.

Further, as shown in FIGS. 3 and 4, the pointed sponge ends 20 and 22 and curved side walls **16*a* and 16*b* of the ink sponge 16 allow the sponge 16 to be easily maneuvered to apply ink only to a desired portion of the image 30. For example, in FIG. 3 an ink sponge assembly 18', the ink sponge 16' of which is impregnated with yellow ink, is arranged above the image to apply ink only to the flow portion 32 of the image 30. On the other hand, the shading of FIG. 4 indicates that: (a) green ink is being applied to the stem/leaf portion 34 with an ink sponge 16" impregnated with green ink; and (b) yellow ink has already been applied (as shown in FIG. 3) to the flower portion 32. The corner 20 of the ink sponge 16" allows a user to apply green ink to the stem of the stem/leaf portion 34 as shown in FIG. 4 without smudging or contaminating the yellow ink that has already been applied to the flower portion 32**.

After the ink has been applied as described using the ink sponges 16' and 16", the stamp 24 is inverted and the stamping portion 28 thereof is brought into contact with a sheet of paper 36. The ink on the image 30 is transferred to the paper sheet 36 to form an ink impression 38 thereon. As shown by the shading in FIG. 5, the ink impression 38 comprises a yellow flower portion 40 and a green stem/leaf portion 42.

While for simplicity the above discussion described the process of forming a two-color ink impression, it should be clear that more than two colors can be applied to the image on any given stamp. For example, with the image 30 formed on the stamp 24 described above, one could easily form a four color ink impression having yellow flower petals, a black flower center, a brown stem, and green leaves. Black ink would be applied to the flower center using one of the pointed ends of the ink sponges. Brown ink could be applied to the stem by tilting the ink sponge and using one of the side edges thereof. The yellow and green ink could be applied much as shown and described above. Accordingly, it should be clear that ink sponge assemblies constructed according to the principles of the present invention provide the user enormous flexibility in the application of color to a stamp such as the stamp 24 described above.

Figure 6:
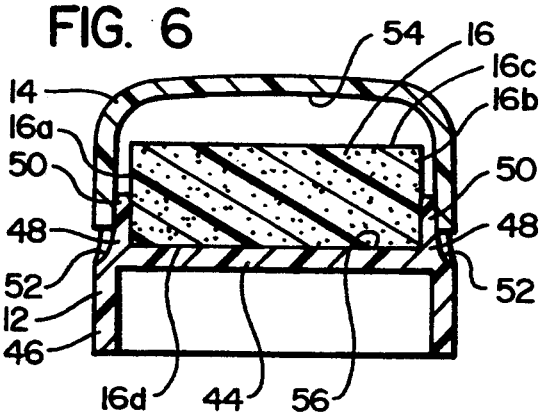
FIG. 6 is an end, cut-away view taken along lines 4 in FIG. 1.

The details of construction of the ink applicator assembly 10 will now be described in further detail with reference to FIGS. 1, 2, and 6. The base portion 12 of the applicator assembly 10 is a single piece of injection molded plastic. The exact shape of the base portion 12 is not essential to the present invention; however, in the preferred embodiment, the base portion 12 generally comprises: (a) a sponge support portion 44 (FIG. 6); (b) a handle portion 46; (c) a perimeter ridge 48; and (d) a pair of locking detents 50 (FIG. 2). Indentations 52 are formed on either side of the base portion 12.

The handle portion 46 and perimeter ridge 48 extend downwardly and upwardly, respectively, from the sponge support portion 44 along the entire perimeter edge thereof. The handle portion 46 allows the user to grasp the ink sponge assembly 18 when in use. The perimeter ridge 48 and the sponge support portion 44 define a narrow cavity with one open side which receives the ink sponge 16.

The locking detents 50 extend upwardly from the perimeter ridge 48 along approximately the center one-third of the sides of the base portion 12. These locking detents 50 engage an inner surface 54 of the lid portion 14 to secure the lid portion 14 to the base portion 12.

The indentations 52 are located on the perimeter ridge 48 immediately below the locking detents 50. These indentations 52 facilitate the removal of the lid portion 14 from the base portion 12 by allowing the user more easily to apply an upward force to the lid portion 14.

The perimeter of the sponge support portion 44 is shaped like a pointed oval and defines the overall configuration of the base portion 12 when viewed from above. Since the handle portion 46 and perimeter ridge 48 extend from the perimeter of the sponge support portion 44, they too are generally pointed-oval when viewed from above.

The ink sponge 16 is formed from open cell foam impregnated with colored ink, and a lower surface **16*d* thereof is attached to an upper surface 56 of the sponge support portion 44. The thickness of the ink sponge 16 is such that the upper surface 16*c* of the ink sponge 16 is spaced approximately: (a) 7/32 of an inch above the sponge support portion upper surface 56; (b) 3/16 of an inch above the top of the perimeter ridge 48; and (c) 3/32 of an inch above the top of the locking projections 50. The ink sponge 16** when viewed from above is generally in the shape of a pointed oval, as will be discussed in further detail below.

The design and construction of the lid portion 14 is not crucial to the present invention; at a minimum, however, the lid portion 14 must be so constructed that: (a) its walls are of sufficient height to prevent the lid portion inner surface 54 from contacting the ink sponge 16 when the lid portion 14 is attached to the base portion 12; (b) its walls are sufficiently far apart to be engaged by the locking detents 50 for the purpose described above; and (c) the lid portion 14 engages the base portion 12 in a manner that prevents contamination or drying out of the ink sponge 16. In the preferred embodiment, the lid portion 14 is generally pointed-oval in shape to match the shape of the base portion 12.

The shape of the ink sponge 16 will now be discussed in further detail. In the preferred embodiment, the ink sponge 16, which has heretofore been referred to as having "pointed-oval shaped" walls, can be perhaps more precisely defined as having two symmetrical, continuously curved side walls **16*a* and 16*b* that intersect at the sponge ends 20 and 22**.

Figure 7:
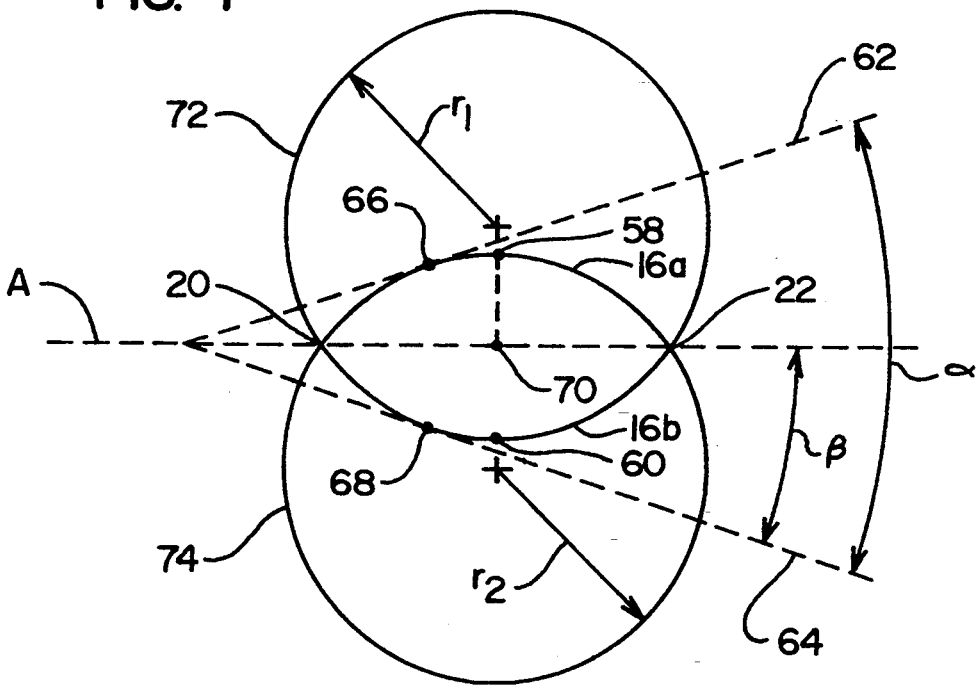
FIG. 7 is a top view schematically depicting the relevant physical characteristics of the present invention.

The angle between these two side walls **16*a* and 16*b* gradually and continuously decreases from the ends 20 and 22 towards points 58 and 60 on the walls 16*a* and 16*b* midway between the two sponge ends 20 and 22. In other words, as shown in FIG. 7, a pair of coplanar, straight lines 62 and 64 can be defined that are tangent to the sponge side walls 16*a* and 16*b* at points 66 and 68 on these walls 16*a* and 16*b* that lie in a plane orthogonal to a centerline A extending through the ends 20 and 22 of the ink sponge. An angle $\alpha$ between these tangential lines gradually and continuously decreases as the points 64 and 66 are moved from the sponge ends 20 and 22 towards the mid-points 58 and 60. At these midway points 58 and 60, the lines 62 and 64 tangent to the two side walls 16*a* and 16*b*** are parallel.

Similarly, an angle $\beta$ between the either of these lines 62 and 64 and the centerline A starts out acute and gradually and continuously decreases from either of the sponge ends 20 or 22 towards the midway points 58 and 60. At these midway points 58 and 60, the lines 62 and 64 tangent to the two side walls **16*a* and 16*b*** are parallel to the centerline A.

Stated in yet another way, these walls adjacent to each of the sponge ends 20 and 22 are substantially ogival in configuration.

The dimensions of the ink sponge 16 of the preferred embodiment are of interest because they optimize the general benefits obtained by the present invention as described above. Specifically, the length from one end 20 to the other end 22 of the sponge is 19/16 inches, and is preferably between one inch and 2½ inches. The width of the ink sponge 16, which is defined as the distance between the midway points 58 and 60 on the walls **16*a* and 16*b*, is preferably 13/16 of an inch and should be between ½ inch and 1½ inches. The angle $\alpha$ between the tangential lines 62 and 64 at the ends 20 and 22 is preferably approximately 100° and should be between 70° and 135°. The angle $\beta$ between the centerline A and either of the tangential lines 62 and 64 is preferably approximately 50° and should be between 35° and 67.5°. The ratio of the length to width of the ink sponge 16 is preferably 2:1 and should be between 1.5:1 and 2.5:1. Similarly, the ratio of the distance between a center point 70 and one of the midway points 58 and 60 and the distance between the center point 70 and one of the ends 20 and 22 is preferably 2:1 and should be between 1.5:1 and 2.5:1. Finally, it should be noted that the ink sponge 16 of the preferred embodiment is formed by the overlapping portions of two circles 72 and 74** having radii $r_1$ and $r_2$ of equal length.

An ink sponge 16 constructed within the parameters just-defined will allow the user to apply ink to an ink stamp in a comfortable and easy fashion.

It should be clear that the present invention may be embodied in forms other than that described above. For example, in the preferred embodiment described above, both ends of the base portion 12 extend beyond the ends of the ink sponge 16. In an alternative embodiment, the ends of the base portion 12 may be cut-off or otherwise tapered back to expose the ends of the ink sponge 16 and thus allow the user to see with more precision the placement of the ends of the sponge 16.

Additionally, while in the preferred embodiment the sponge 16 is generally shaped like a pointed oval, the sponge 16 may be embodied in other shapes, such as half-moon, crescent, or ogival, that result in any two sides that intersect at a point, where the angle between the two sides is acute. Accordingly, while the pointed-oval-shaped sponge 16 described above is particularly advantageous in practicing the present invention, at least some of the benefits of the present invention may be achieved by sponges formed in other shapes.

The above-described embodiment is therefore to be considered in all respects illustrative and not restrictive, the scope of the invention being indicated by the appended claims rather than the foregoing description. All changes that come within the meaning and scope of the claims are intended to be embraced therein.

I claim:

1. An apparatus for applying ink to an image on an ink stamp, comprising:

a. a base portion having a mounting surface and a perimeter ridge surrounding the mounting surface and a plurality of locking detents mounted on the perimeter ridge;

b. an ink-impregnated sponge attached to the mounting surface of the base portion inside the perimeter ridge, the ink impregnated sponge having an inking surface, a centerline, and at least two side walls that intersect at a first end point located on the centerline, where i. an angle between the two side walls is between 70° and 135° at the first and second end points and gradually and continuously decreases away from the first and second end points towards the middle of the sponge, and ii. the two side walls become parallel at midway points on the side walls located midway between the first and second end points; and c. a cover member that engages the locking detents on the base portion in a manner that allows the cover to be manually removed from and attached to the base portion to cover the sponge;

d. wherein the two side walls are gradually and continuously curved between the first and second end points.

2. An apparatus as recited in claim 1, in which a distance between the first and second side end points along the centerline is between one inch and two and one-half inches.

3. An apparatus as recited in claim 1, in which a distance between the midway points is between one-half inch and one and one-half inches.

4. An apparatus as recited in claim 2, in which the two side walls are parallel at midway points along the side walls midway between the first and second end points, where a distance between these midway points is between one-half inch and one and one-half inches.

5. An apparatus as recited in claim 1, in which a length of the sponge is defined as a distance between the first and second end points and a width of the sponge is defined as a distance between the midway points, where a ratio of length of the sponge to width of the sponge is between 1.5:1 and 2.5:1.

* * * * *